United States Patent [19]

Price

[11] Patent Number: 4,764,127

[45] Date of Patent: Aug. 16, 1988

[54] ELECTRICAL CONNECTOR FOR HIGH-LEVEL AUDIO SIGNALS

[75] Inventor: Edison A. Price, New York, N.Y.

[73] Assignee: Edison Price Incorporated, New York, N.Y.

[21] Appl. No.: 55,236

[22] Filed: May 28, 1987

[51] Int. Cl.[4] ..... H01R 13/74

[52] U.S. Cl. ..... 439/551; 439/565; 439/807; 439/815

[58] Field of Search ..... 439/544, 562–565, 439/569, 550–551, 807, 815, 863–864, 835, 836, 838

[56] References Cited

U.S. PATENT DOCUMENTS

| | | | |
|---|---|---|---|
| 2,806,999 | 9/1957 | Pichitino | 439/551 |
| 2,948,773 | 8/1960 | Hawes | 439/569 |
| 3,750,090 | 7/1973 | Teman | 439/551 |
| 4,354,725 | 10/1982 | Herbaugh et al. | 439/551 |
| 4,405,196 | 9/1983 | Fulton | 439/551 |
| 4,480,151 | 10/1984 | Dozier | 439/544 |
| 4,486,058 | 12/1984 | Takagi et al. | 439/544 |

*Primary Examiner*—John McQuade
*Attorney, Agent, or Firm*—Brumbaugh, Graves, Donohue & Raymond

[57] ABSTRACT

An electrical connector for an audio product, such as an amplifier and a loudspeaker, comprises a rod-shaped body and a clamping sleeve; the rod-shaped body having a rear portion, a front portion and an intermediate portion; the rear portion having an axial hole at its end, a segment of the end being ground away from the side to form a solder lug, and having male threads between the end and the intermediate portion; the intermediate portion having a flange and a knurled segment between the flange and the male threads of the rear portion; the front portion having a slot across its diameter and an axial hole in the slot, both of which extend from its end substantially to the flange, and having a cylindrical segment adjacent the flange and having a wider segment with male threads and a tapered end; the clamping sleeve having female threads engageable with the male threads of the front portion of the rod-shaped body and having an internal tapered end adjacent the female threads and engageable with the tapered end of the front portion of the rod-shaped body. The electrical connector makes possible tight and intimate non-permanent electrical connection of unterminated wire and/or of wire terminations, such as spade lugs, banana plugs and double banana plugs, to provide enhanced electrical and hence sonic properties.

13 Claims, 5 Drawing Sheets

ELECTRICAL CONNECTOR FOR HIGH-LEVEL AUDIO SIGNALS

BACKGROUND OF THE INVENTION

The present invention is an improved electrical connector for high-level signal applications in consumer and professional audio products. Such electrical connectors are used as audio signal output terminals on audio amplifiers and as audio signal input terminals on loudspeakers, being permanently attached to said products and allowing said products to be electrically interfaced to one another by means of non-permanent connection with conductive cables.

Conventional electrical connectors of this sort, known as binding posts, are of standardized design, dimensions, and materials, manufactured by many different firms and installed as original equipment on audio amplifiers and loudspeakers from many different manufacturers of said products.

Conventional electrical connectors of this sort are intended to allow non-permanent electrical connection involving the use of a variety of standardized and widely available wire terminations, including but not limited to spade lugs, banana plugs, and double banana plugs. Conventional electrical connectors of this sort are also intended to allow non-permanent electrical connection involving the use of bare wire without said terminations.

However, conventional electrical connectors of this sort do not permit intimate contact with the abovementioned wire terminations over a significant area. Further, conventional electrical connectors of this sort are not sized and shaped to allow the use of heavy-gauge unterminated wire, said wire being favored by audio enthusiasts as possessing superior electrical and hence sonic properties.

Still further, conventional electrical connectors of this sort do not allow the use of unterminated wire in such a way that a group of individual wire strands may be compressed and held in intimate contact over a significant area. Further, in said applications with the use of unterminated wire, conventional electrical connectors of this sort do not provide a reliable means of routing or dressing the wire in order that individual wire strands will be prevented from separating from the main group of strands and possibly making unwanted contact with an adjacent connector. Said unwanted contact results in a direct short, and has been known to cause serious damage to audio amplifiers.

Furthermore, conventional electrical connectors of this sort do not allow the non-permanent electrical connection to be made significantly tight, said tightness being generally accepted as a means of enhancing the electrical and hence sonic properties of a given nonpermanent electrical connection.

Still further, conventional electrical connectors of this sort are typically made from brass, subsequently plated with nickel and/or gold. All of said materials have been demonstrated to exhibit uniformly low and/or non-linear (frequency-dependent) conductivity characteristics as compared to other conductive materials available for audio applications.

SUMMARY OF THE INVENTION

It is an object of the present invention to provide an improved electrical connector for high-level signal applications in audio amplifiers and loudspeakers, which overcomes the above-mentioned disadvantages of existing electrical connectors.

A further object is to provide an improved electrical connector that can be fastened securely to audio amplifiers and loudspeakers, with regard to both the mechanical aspect of the attachment to the walls of said products, and to the permanent electrical connection to the internal circuity of said products, significantly improving upon conventional electrical connectors in these regards.

A still further object is to provide an improved electrical connector that can be easily retro-fitted to existing samples of said audio amplifiers and loudspeakers, as a direct replacement for the (existing) conventional electrical connectors of this sort.

The electrical connector of the present invention for audio products comprises a rod-shaped body and a clamping sleeve;

the rod-shaped body having a rear portion, a front portion and an intermediate portion;

the rear portion having an axial hole at its end, a segment of the end being ground away from the side to form a solder lug, and having male threads between the end and the intermediate portion;

the intermediate portion having a flange and a knurled segment between the flange and the male threads of the rear portion;

the front portion having a slot across its diameter and an axial hole in the slot, both of which extend from its end substantially to the flange, and having a cylindrical segment adjacent the flange and having a wider segment with male threads and a tapered end;

the clamping sleeve having female threads engageable with the male threads of the front portion of the rod-shaped body and having an internal tapered end adjacent the female threads and engageable with the tapered end of the front portion of the rod-shaped body.

Other components or accessories useable with the electrical connector include a pair of hex nuts, a washer sleeve, an insert block, a plastic housing and a pair of counterbored plastic washers described below.

DESCRIPTION OF THE DRAWINGS

In the drawings, which are non-scalar.

DETAILED DESCRIPTION OF THE INVENTION

Figure 1:
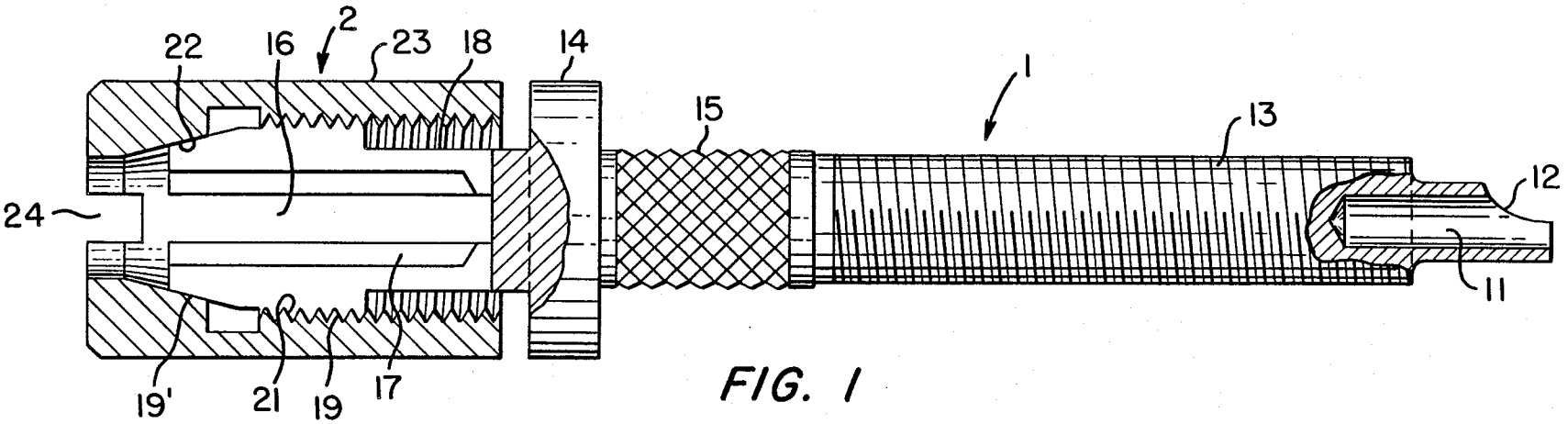
FIG. 1 is a side view, partly in cross-section, of an assembly of the rod-shaped body and the clamping sleeve of the electrical connector.
Figure 2A:
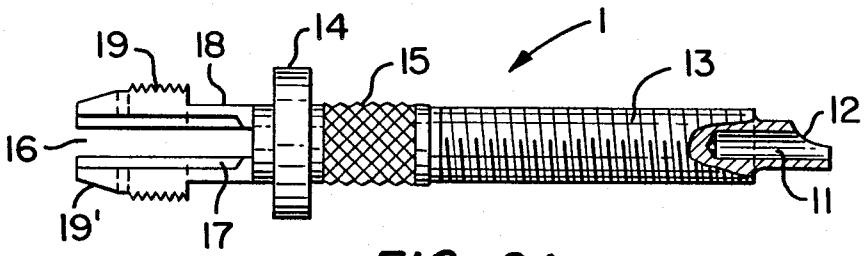
FIG. 2A is a side view, partly in cross-section.
Figure 2B:
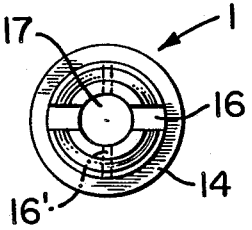
FIG. 2B is a front end view of the rod-shaped body of the electrical connector.

As shown in FIGS. 1 and 2, the electrical connector has a rod-shaped body 1 which is machined from a solid rod. The body 1 has rear, front and intermediate portions.

The rear portion of the body 1 has an axial hole 11 at its end. A segment 12 of the end is ground away from the side to form a solder lug for permanent electrical connection to the internal circuitry of the audio amplifier or loudspeaker on which the electrical connector is to be installed. The rear portion also has male threads 13 between the end and the intermediate portion.

Figure 4B:
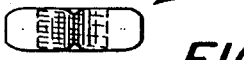
FIG. 4A is a top view and FIG. 4B is a side view of the hex nut for mounting the electrical connector into a wall of an audio product.
Figure 4A:
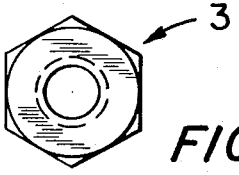

The intermediate portion of the body 1 has a flange 14 which locates the position of the body 1 against the surface on which it is to be installed and which provides a surface against which a wire termination or unterminated wire may be tightened securely as a means of non-permanent electrical connection. The intermediate portion also has a knurled segment 15 between the flange 14 and the male threads 13 of the rear portion. The knurled segment 15 allows the body 1 to be molded into a separate plastic housing 6 (FIGS. 7–10), said housing 6 being one means of fastening the electrical connector to the wall W of an audio amplifier or loudspeaker. A pair of hex nuts 3 (FIG. 4) and a pair of adjacent counterbored plastic washers 7 (FIG. 11) engageable with the male threads 13 are supplied as an alternate means of fastening the electrical connector to the wall W of an audio amplifier or loudspeaker.

The front portion of the body 1 has slot 16 machined across its diameter. The purpose of the slot 16 is to allow insertion of heavy gauge, usually stranded, unterminated wire as a means of non-permanent electrical connection, as will be described below.

The front portion of the body 1 also has an axial hole 17 in the slot 16 and, optionally, can have a slit 16′ (FIG. 2B) transverse to the slot 16. The slot 16, slit 16′ and the axial hole 17 extend from the end of the front portion substantially to the flange 14. The purpose of this axial hole 17 is to allow insertion of an industry-standard banana plug as a means of non-permanent electrical connection, as will be described below.

The front portion of the body 1 further has a cylindrical segment 18 adjacent the flange 14. The purpose of this cylindrical segment 18 is to allow intimate contact with industry-standard spade lugs as a means of non-permanent electrical connection, as will be described below.

The front portion of the body 1 also has a wider segment with male threads 19 and a tapered (15°) end 19′ to allow the installation of a clamping sleeve 2 thereon as shown in FIG. 1.

Figure 3A:
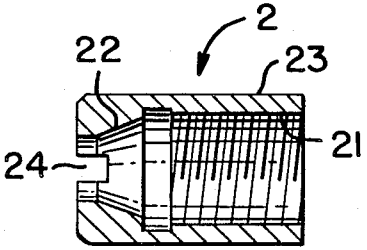
FIG. 3A is a side cross-sectional view and FIG. 3B is a front end view of the clamping sleeve of the electrical connector.
Figure 3B:
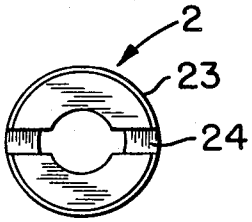

As shown in FIGS. 1 and 3, the clamping sleeve 2 has female threads 21 engageable with the male threads 19 of the front portion of the body 1 and has an internal tapered (15°) end 22 adjacent the female threads 21 and engageable with the tapered (15°) end 19 of the front portion of the body 1. When turned clockwise, in the direction of the flange 14, the clamping sleeve 2 allows non-permanent electrical connections with wire terminations or unterminated wire to be made in an extremely intimate and tight fashion, as will be described below.

The clamping sleeve 2 has a knurled outer surface 23 to facilitate grasping it and tightening it. The front end of the clamping sleeve 2 has a slot 24 across its diameter. This slot 24 will accept the blade of a large screwdriver or other similar tool to further facilitate tightening the clamping sleeve 2

Upon ultimate tightening of the clamping sleeve 2 onto the body 1, the tapered end 22 engages the tapered end 19′ and serves to collapse, with the aid of slit 16′, the front portion of the body 1, decreasing its inside diameter. The purpose of this feature is to enhance the intimacy and tightness of contact with an industry standard banana plug as a means of non-permanent electrical connection, as will be described below.

Figure 5A:
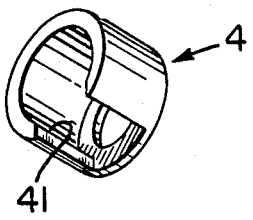
FIG. 5A is a perspective view.
Figure 5B:
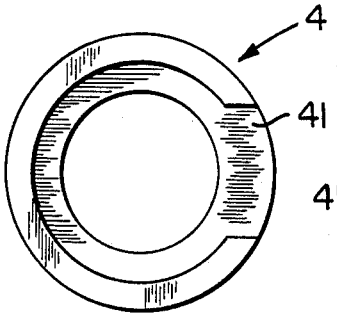
FIG. 5B is an end view and FIG. 5C is a side view of the washer sleeve.
Figure 5C:
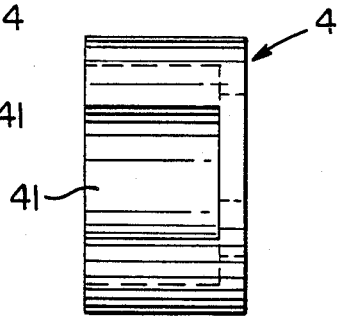
Figure 10B:
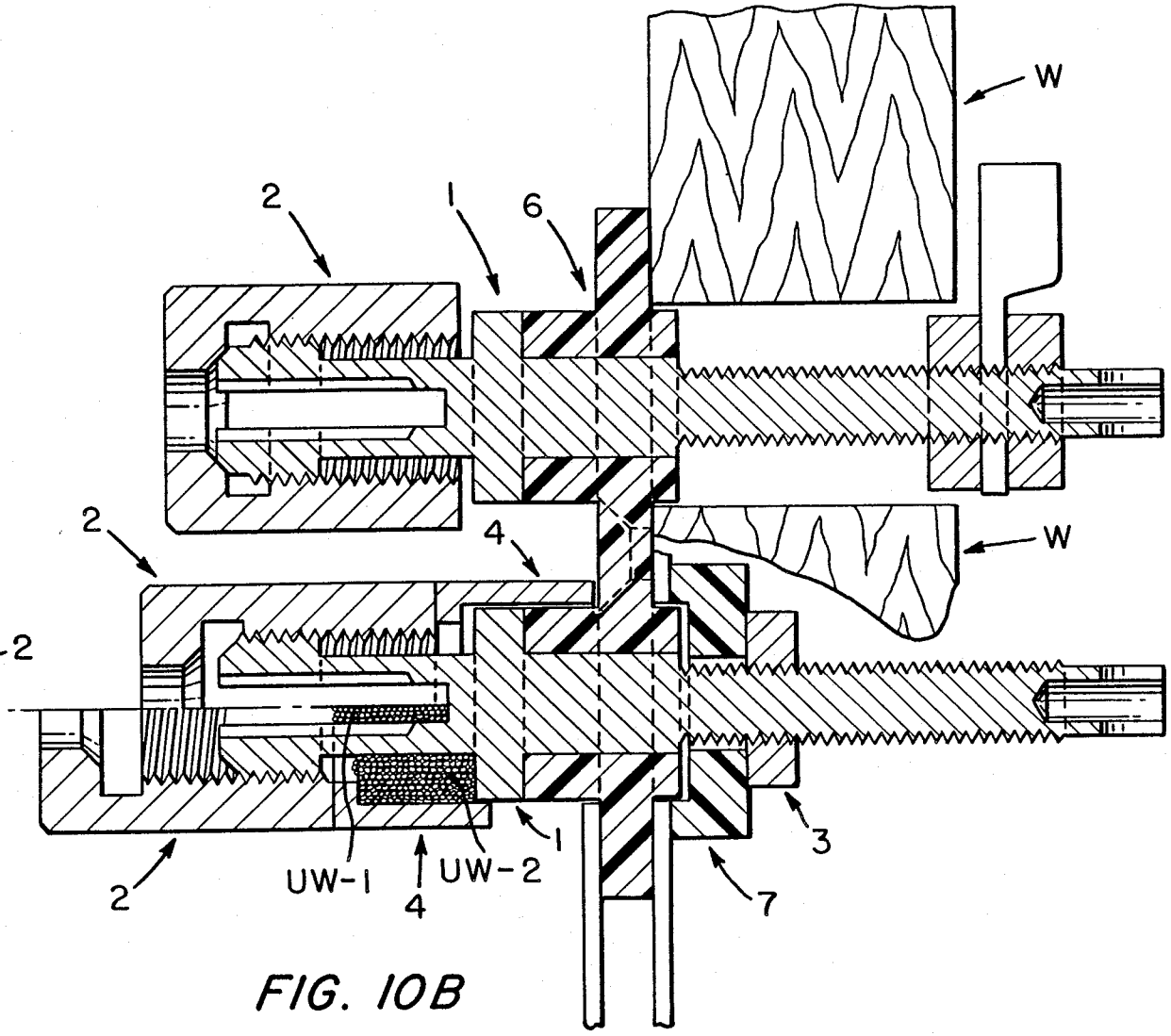
FIG. 10A is a front end view and FIG. 10B is a cross-sectional view of a pair of electrical connectors in various degrees of assembly placed in the plastic housing, mounted into a wall of an audio product, and showing unterminated wires in two variant locations.
Figure 10A:
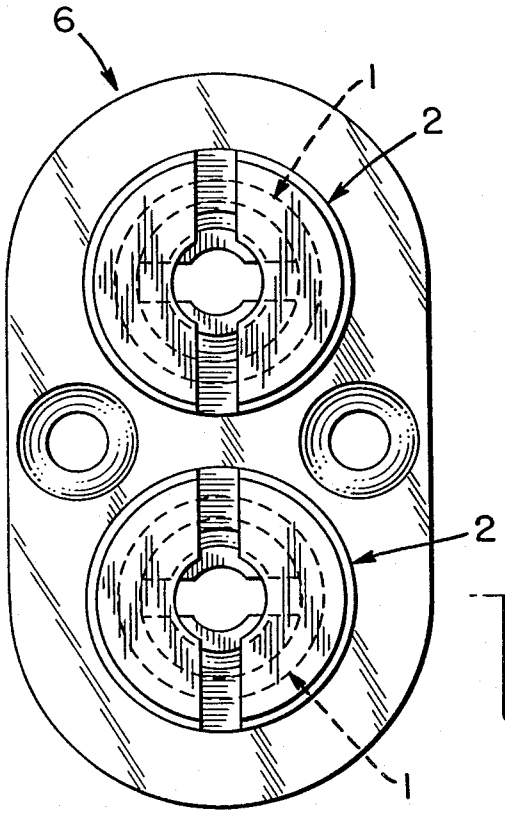

As shown in FIGS. 5 and 10, the present invention also includes a washer sleeve 4 as a separate component. The washer sleeve 4, which is mountable on the cylindrical segment 18 of the front portion of the rod-shaped body 1 and extends around the flange 14, has an opening 41 on its perimeter to permit the ingress and egress of unterminated wire, said wire being looped around the cylindrical segment 18 of the rod-shaped body 1 in front of the flange 14 as a means of non-permanent electrical connection, as will be described below.

Figure 6:
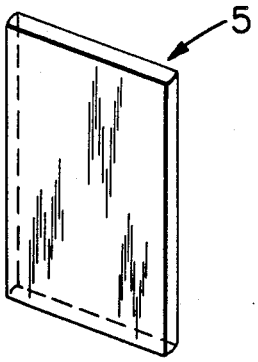
FIG. 6 is a perspective view of the insert block.

As shown in FIG. 6, the present invention also includes an insert block 5 fittable into the slot 16 from the front of the rod-shaped body 1 after a segment of unterminated wire has been inserted therein, as a means of enhancing the intimacy and tightness of this method of nonpermanent electrical connection, as will be described below. The dimensions of the insert block 5 conform to those of the slot 16 except the height is less than that of the slot 16.

In accordance with the present invention, there is an improvement in the number of ways a non-permanent electrical connection may be made to an audio amplifier or loudspeaker, and an improvement in the quality of these connections, in terms of the desired characteristics of intimacy (contact over a significantly large surface area) and tightness, as compared to conventional electrical connections of this sort. These improvements are made manifest in a number of separate and distinctly different methods of non-permanent electrical connection made possible by the electrical connector of the present invention, as enumerated:

(1) Unterminated wire inserted into the slot 16 (See FIG. 10B): It is very easy to insert all of the fine strands of even a very heavy-gauge unterminated wire UW-1 (which is uninsulated adjacent its end) through the slot 16 by introducing the wire UW-1 through the open end of the slot 16, a portion at a time, if necessary. After all the wire UW-1 is in the slot 16, the clamping sleeve 2 is threaded onto the front portion of the body 1 by engagement of the female threads 21 with the male threads 19. When this clamping sleeve 2 is tightened, the wire UW-1 is strongly compressed against the bottom of the slot 16, insuring intimate contact over a wide area. This tightening of the clamping sleeve 2 also serves to compress the wire UW-1 against itself, and serves also to brace the wire UW-1 against the sides of the slot 16. This side pressure would normally cause the body 1 to bulge outward were it not for the fact that the clamping sleeve 2 acts to resist this force and therefore to maintain the shape of the slot 16 in the body 1. In addition to being intimately and tightly compressed against the bottom and inner sides of the slot 16, the wire strands are, of course, also likewise compressed against the underside of the clamping sleeve 2 by its tightening action. After the clamping sleeve 2 is fully tightened, any excess wire UW-1 that passes through and beyond the slot 16 may easily be trimmed by a knife or a wire cutter, eliminating any unwanted stray strands of wire UW-1 that could otherwise create an undesirable electrical short through contact with any adjacent conductive element, such as a metal chassis or an adjacent electrical connector.

As a variation on this method of non-permanent electrical connection, the insert block 5 may be fitted into the slot 16 on top of the unterminated wire UW-1, after said wire UW-1 has been inserted into the slot 16 and before the clamping sleeve 2 has been installed. The presence of the insert block 5 further enhances the intimacy and tightness of the electrical connection.

(2) Unterminated wire looped around the cylindrical segment 18 (See FIG. 10B): When dealing with unterminated wire UW-2 (which is uninsulated adjacent its end) of a somewhat smaller gauge than described above in method #1, the electrical connector provides an easy means of making non-permanent electrical connection by wrapping unterminated wire UW-2 (stranded or solid) around the cylindrical segment 18 adjacent the flange 14 of the body 1. In this method of electrical connection, the wire UW-2 should be wrapped around the cylindrical segment 18 a full 360°, such that the loop thus formed will begin and end at virtually the same point relative to the perimeter of the body 1. The clamping sleeve 2 may then be installed on the body 1 and tightened, compressing the wire UW-2 tightly against the flange 14, against the outer sides of the cylindrical segment 18, against the underside of the clamping sleeve 2, and against itself, resulting in a nonpermanent electrical connection of excellent intimacy and tightness.

As a variation on this method of non-permanent electrical connection, the washer sleeve 4 may be fitted to the body 1 on top of the unterminated wire UW-2, after said wire UW-2 has been looped around the cylindrical segment 18 and before the clamping sleeve 2 has been installed. The inside diameter of the washer sleeve 4 is slightly greater than the outside diameter of the flange 14, thus allowing it to be progressively tightened in order to compress the unterminated wire UW-2, further enhancing the intimacy and tightness of the non-permanent electrical connection. The washer sleeve 4 used thus, also serves to confine the unterminated wire UW-2 which is wrapped around the cylindrical segment 18, making for a connection of neat appearance, and preventing unwanted stray strands of wire UW-2 from making undesirable contact with any adjacent conductive elements.

(3) Spade lug used as a wire termination: The electrical connector has been designed in such a way that its size and shape provides excellent contact with industry standard spade lugs used as wire terminations for non-permanent electrical connection. Such a spade lug may be slipped onto the cylindrical segment 18 immediately in front of the flange 14. Subsequently, the clamping sleeve 2 may be tightened onto the body 1, thus compressing the spade lug against the flange 14, against the outer sides of the cylindrical segment 18, and against the underside of the clamping sleeve 2, resulting in a non-permanent electrical connection of excellent tightness and intimacy.

(4) Banana plug used as a wire termination: The electrical connector has been designed to provide excellent contact with industry standard banana plugs used as wire terminations for non-permanent electrical connections. First, the clamping sleeve 2 is installed onto the body 1, but not tightened all the way. A banana plug is then inserted into the axial hole 17 of the body 1 and the clamping sleeve 2 is then tightened as far as possible. Due to the tapered end 19' of the body 1 and the complementary tapered end 22 of the clamping sleeve 2, this tightening action serves to collapse the front portion of the body 1, decreasing its inner diameter and forcing tight, intimate contact between the inner diameter of the front portion of the body 1 and the entire outer portion of the banana plug. It should be noted that this collapsing is aided by the slit 16' (FIG. 2B) and would be impossible were it not for the slot 16.

(5) Various combinations of the above methods: The electrical connector has been designed in such a way that, in order to accomodate bi-wiring (i.e., an audio system hookup scheme whereby two pairs of conductive speaker cables are used between a single speaker and an audio amplifier's output) more than one non-permanent electrical connection can be accomplished on a single sample of the electrical connector at the same time.

For example: The electrical connector is configured such that the same time that a non-permanent electrical connection has been made in accordance with the above method #3 (spade lug used as a wire termination), an additional non-permanent electrical connection may be made using the above method #4 (banana plug used as a wire termination).

Further, at the same time that a non-permanent electrical connection has been made in accordance with either the above method #1 (unterminated wire inserted into the slot 16) or the above method #2 (unterminated wire looped around the cylindrical segment 18), an additional non-permanent electrical connection may be made using the above method #4 (banana plug used as a wire termination).

Further still, the size and shape of the body 1 allow the electrical connector to be used for multiple non-permanent electrical connections in accordance with the above method #3 (spade lug used as a wire termination) at the same time. Said spade lugs may be slipped onto the cylndrical segment 18 of the body 1 one atop the other, immediately in front of the flange 14, and subsequently tightened with the clamping sleeve 2. This approach results in a non-permanent electrical connection of excellent intimacy and tightness. The number of spade lugs that may be thus used at the same time is limited only by the thickness of the lugs used, an aspect of the dimension of said wire terminations that is non-standard.

To further accomplish the objectives of the present invention, the following components—the rod-shaped body 1, the clamping sleeve 2, the washer sleeve 4, the insert block 5 and the hex nuts 3—are each machined from the same material, which is tellurium copper. Through the use of this material, the electrical connector exhibits the highest possible degree of electrical conductivity consistent with the necessary machinability and hence sonic qualities.

Further, the above-mentioned components 1, 2, 3, 4, 5 are machined from grain-oriented tellurium copper rods, with said orientation identified by the mill of origin, and in recognition of the fact that the electrical conductivity of this material is directional with respect to the orientation of said grain. By manufacturing all these components 1, 2, 3, 4, 5 with attention paid to the orientation of the grain and hence the optimal direction of electrical conductivity, said electrical conductivity and hence sonic properties may be further maximized.

To further accomplish the objectives of the present invention and as shown in FIGS. 7–10, a separate plastic housing 6, made as a polycarbonate molding, may be supplied, into which pairs of the electrical connectors are molded or inserted. Said housing 6 is an alternate means of fastening the electrical connectors to an audio amplifier or loudspeaker.

Further, the housing 6 is designed such that, with a pair of the electrical connectors installed in the spaced holes 61 and tightly engaging the knurled segment 15 of the rod-shaped body 1, as described above, their exact centers will be spaced exactly apart a distance which matches the spacing used for industry standard double banana plugs and thus allowing their use as an alternate means of non-permanent electrical connection (as a variation on method of connection #4, described above).

Further, the housing 6 is designed such that it may be installed on an audio amplifier or loudspeaker, e.g., via a screw in the countersunk screw hole 62, from either the inside of said product or the outside of said product, thus easing installation of the electrical connectors of the present invention considerably as compared to conventional electrical connectors of this sort, and enhancing the usefulness of the electrical connectors of the present invention as a retro-fittable accessory.

Figure 11A:
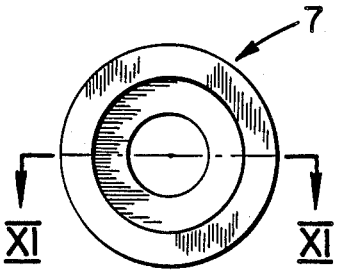
FIG. 11A is a bottom view and FIG. 11B is a cross-sectional view, taken on line XI—XI of FIG. 11A, of the counterbored plastic washer useable with the hex nut shown in FIGS. 4A and 4B.
Figure 11B:
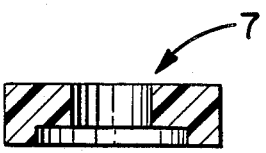
Figure 7:
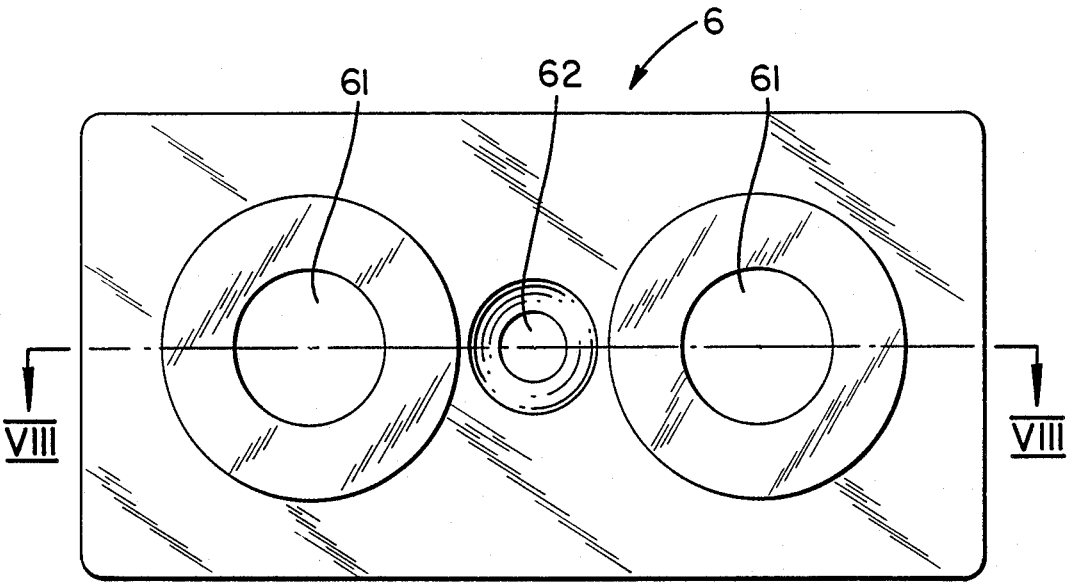
FIG. 7 is a top view and FIG. 8 is a cross-sectional view, taken on line VIII—VIII of FIG. 7, of the plastic housing for mounting a pair of the electrical connectors into a wall of an audio product.
Figure 8:
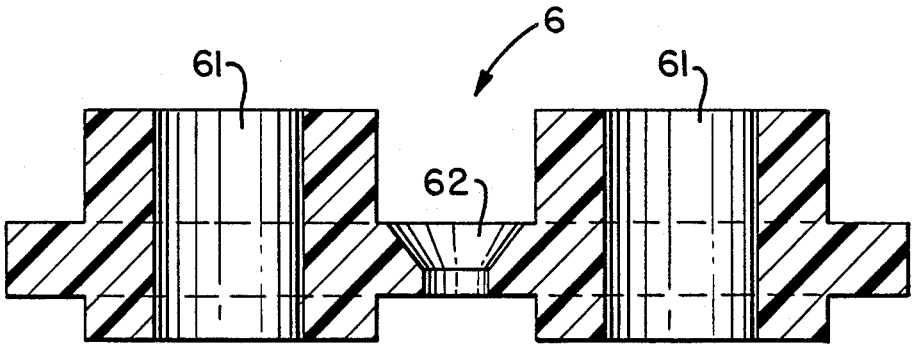
Figure 9:
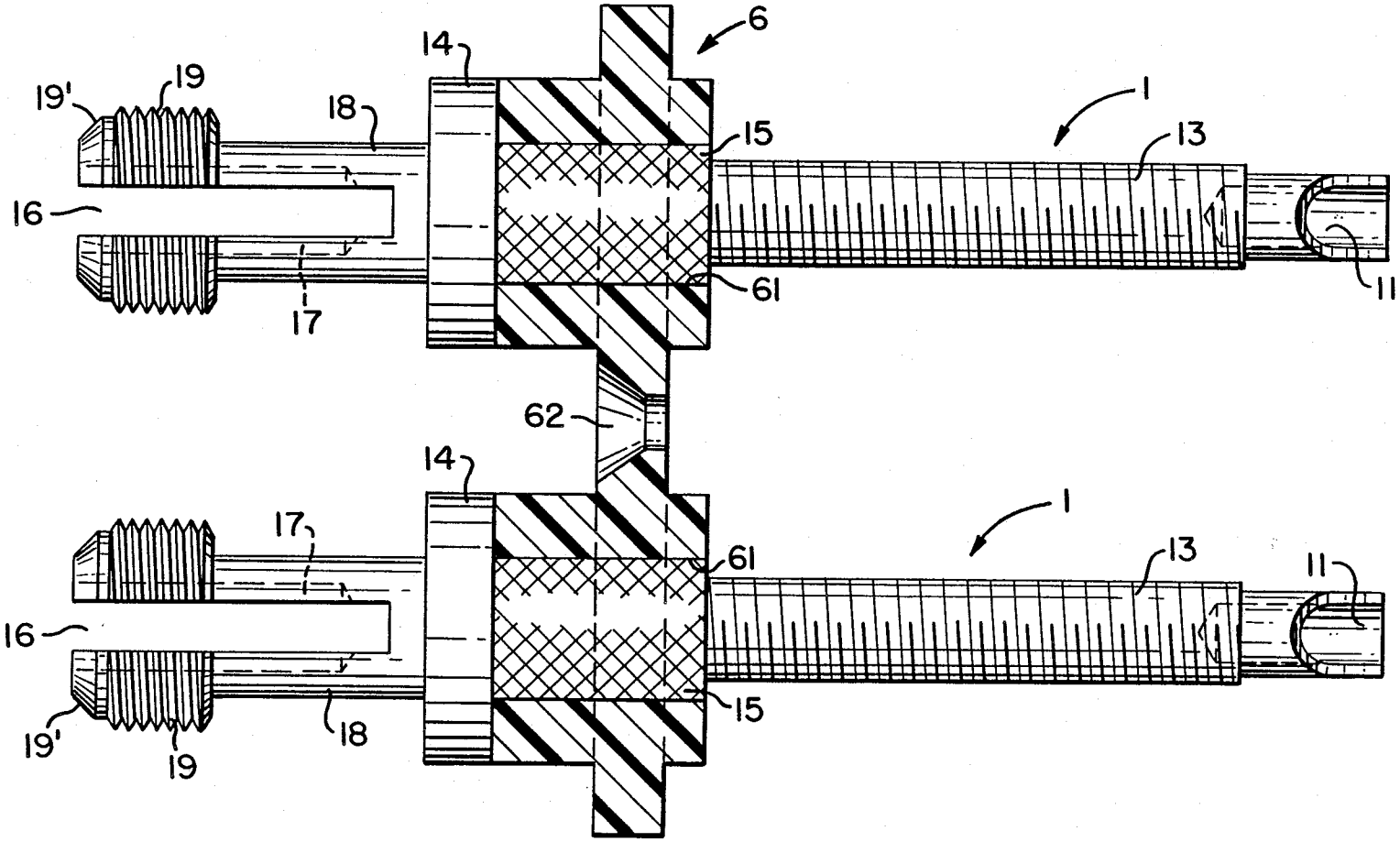
FIG. 9 is a side view of two rod-shaped bodies of a pair of electrical connectors placed in the plastic housing, shown in cross-section, of FIG. 8.

As shown in FIG. 11, the electrical connector includes counterbored plastic (nylon) washers 7 adjacent to the hex nuts 3 as further components. The counterbored plastic washers may be used when the electrical connector is being installed on the conductive chassis of an audio amplifier or loudspeaker, and/or when the electrical connector is being installed without the plastic housing 6 described above. The counterbored plastic washers 7 will permit a sturdy mechanical attachment of the electrical connector to said audio products, and will further serve to insulate the electrical connector from any conductive surroundings, thus preventing undesirable shorting between the electrical connector and any adjacent conductive elements.

What is claimed is:

1. An electrical connector for an audio product which comprises a rod-shaped body and a clamping sleeve;

the rod-shaped body having a rear portion, a front portion and an intermediate portion;

the rear portion having an axial hole at its end, a segment of the end being ground away from the side to form a solder lug, and having male threads between the end and the intermediate portion;

the intermediate portion having a flange and a knurled segment between the flange and the male threads of the rear portion;

the front portion having a slot across its diameter and an axial hole in the slot, both of which extend from its end substantially to the flange, and having a cylindrical segment adjacent the flange and having a wider segment with male threads and a tapered end;

the clamping sleeve having female threads engageable with the male threads of the front portion of the rod-shaped body and having an internal tapered end adjacent the female threads and engageable with the tapered end of the front portion of the rod-shaped body.

2. An electrical connector as defined by claim 1, wherein the front portion of the rod-shaped body has a slit transverse to the slot.

3. An electrical connector as defined by claim 1, wherein the clamping sleeve has a knurled outer surface.

4. An electrical connector as defined by claim 1, wherein the clamping sleeve has a slot across its diameter at its front end.

5. An electrical connector as defined by claim 1, which further comprises a pair of hex nuts engageable with the male threads on the rear portion of the rod-shaped body for installing the electrical connector into a hole in a wall of the audio product.

6. An electrical connector as defined by claim 5, which further comprises a pair of counterbored plastic washers adjacent to the hex nuts.

7. An electrical connector as defined by claim 1, which further comprises a washer sleeve with an opening on its perimeter, said washer sleeve being mountable on the cylindrical segment of the front portion of the rod-shaped body and extending around the flange.

8. An electrical connector as defined by claim 1, which further comprises an insert block fittable into the slot of the front portion of the rod-shaped body, said insert block having a height less than that of the slot.

9. An electrical connector as defined by claim 1, which further comprises a plastic housing having two spaced holes tightly engageable with the knurled segment of the rod-shaped body for attaching a pair of the electrical connectors into spaced holes in a wall of the audio product.

10. An electrical connector as defined by any of claims 1–4 wherein the rod-shaped body and the clamping sleeve are each made of grain-oriented tellurium copper.

11. An electrical connector as defined by claim 5 wherein the hex nuts are made of grain-oriented tellurium cooper.

12. An electrical connector as defined by claim 7 wherein the washer sleeve is made of grain-oriented tellurium copper.

13. An electrical connector as defined by claim 8 wherein the insert block is made of grain-oriented tellurium copper.

* * * * *